US005321377A

United States Patent [19]

Aharonian

[11] Patent Number: 5,321,377

[45] Date of Patent: Jun. 14, 1994

[54] ELECTROMAGNET FOR RELAYS AND CONTACTOR ASSEMBLIES

[75] Inventor: Hrair N. Aharonian, Southfield, Mich.

[73] Assignee: Kaloust P. Sagoian, Southfield, Mich.

[21] Appl. No.: 6,632

[22] Filed: Jan. 21, 1993

[51] Int. Cl.[5] ..... H01H 51/22

[52] U.S. Cl. ..... 335/78; 335/80; 335/128

[58] Field of Search ..... 335/78-86, 335/124, 128, 131

[56] References Cited

U.S. PATENT DOCUMENTS

| | | | |
|---|---|---|---|
| 2,911,493 | 11/1959 | Weber et al. | 200/87 |
| 3,970,973 | 7/1976 | Langree | 335/203 |
| 4,020,434 | 4/1977 | Jaegle et al. | 335/230 |
| 4,323,869 | 4/1982 | Minks | 335/275 |
| 4,475,093 | 10/1984 | Kobler | 335/78 |
| 4,564,828 | 1/1986 | Lowe | 335/128 |
| 4,825,179 | 4/1989 | Nagamoto et al. | 335/80 |
| 4,956,623 | 9/1990 | Rolf-Dieter | 335/80 |
| 5,070,315 | 12/1991 | Kuzukawa et al. | 335/128 |
| 5,216,396 | 6/1993 | Stahly | 335/78 |

OTHER PUBLICATIONS

Russian Inventor's Certificate, USSR State Committee on Inventions and Discoveries at the State Committee on Science and Techniques of the USSR, by H. N. Aharonian, Jul. 15, 1989.

*Primary Examiner*—Lincoln Donovan

*Attorney, Agent, or Firm*—Reising, Ethington, Barnard, Perry & Milton

[57] ABSTRACT

An electromagnet for a relay and contactor assembly having an L-shaped armature pivotally secured to an L-shaped core for minimizing flux dispersion and magneto-motive force requirements. One arm of the core is pivotally connected to one leg of the armature. A coil utilizing a minimum amount of copper material is wound around the core near its vertex. Several groups of contacts are located on the side of the pivot opposite the coil and are operated by an extension arm attached to the armature. The L-shaped armature and the L-shaped core create two working air gaps which cooperatively attract and maintain the armature in its energized position when the coil is energized. A spring may bias the armature toward a de-energized position. Alternatively, the armature may be biased by gravity toward the de-energized position.

11 Claims, 2 Drawing Sheets

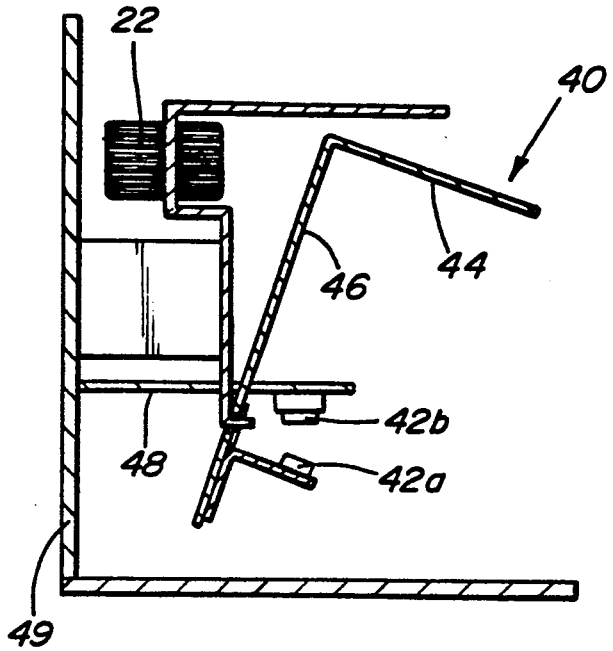
Fig-3
Fig-4
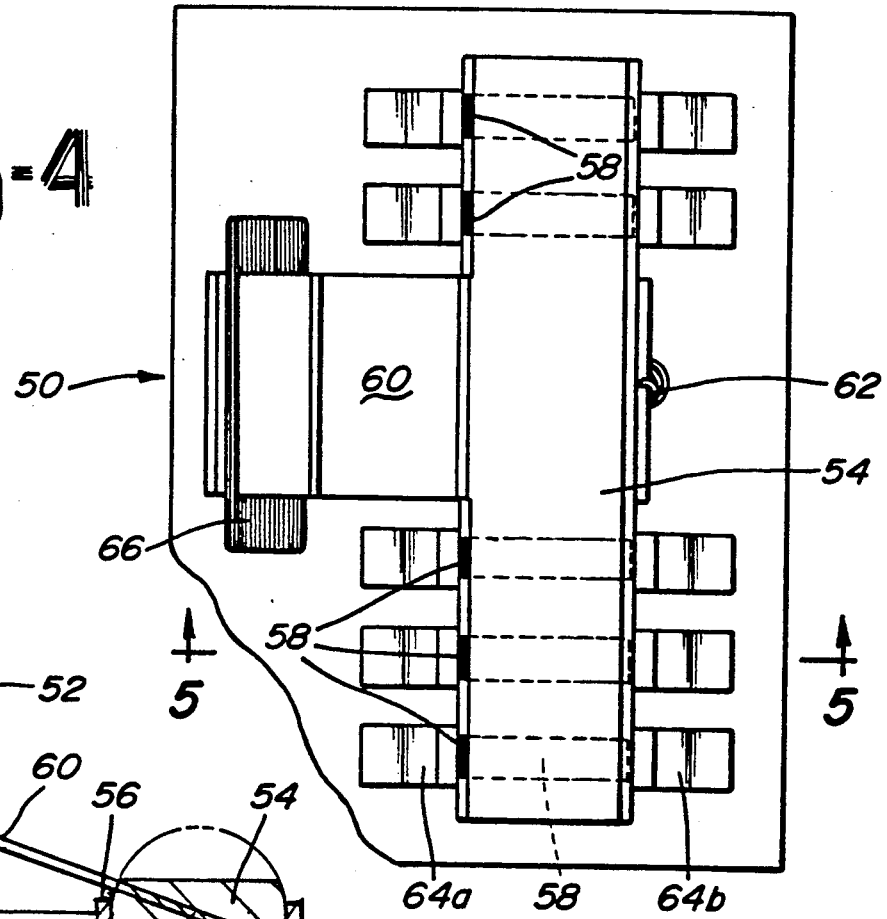
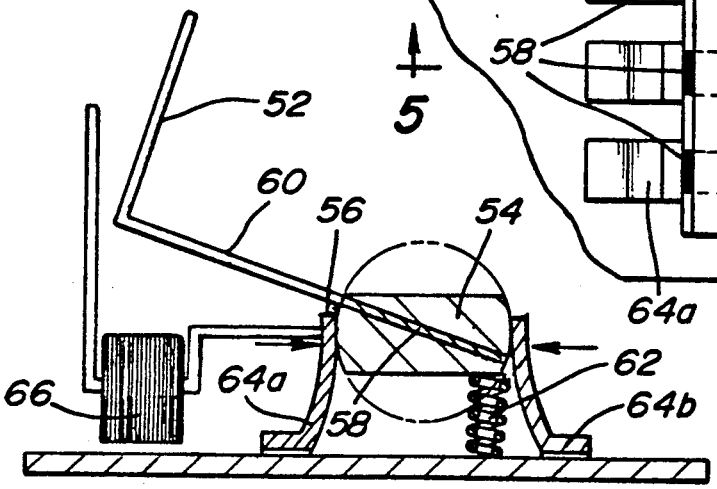
Fig-5

ELECTROMAGNET FOR RELAYS AND CONTACTOR ASSEMBLIES

TECHNICAL FIELD

This invention relates generally to electromagnets for relays and contactor assemblies and more specifically to compact electromagnets having a pivotable L-shaped armature structure.

BACKGROUND ART

Conventional electromagnet structures having a U-shaped core, a coil wound around one leg of the core, and a spring biased armature attached to the other leg of the core are used for numerous switching applications. Electromagnet relay contacts are usually attached to the armature and the core so that normally open contacts meet when coil is energized. Relays using this type of electromagnet encounter several disadvantages relating to shortcomings in the electromagnet.

In conventional electromagnets, the armature must rotate eight to ten degrees while the flux dispersion approaches 40–50% of the total generated flux. To operate the electromagnet, a relatively large amount of magnetomotive force (MMF) is needed to generate enough flux to compensate for the high degree of flux dispersion.

A large quantity of copper winding is required to produce a coil having the required MMF and for compensating for the high amount of flux dispersion. In addition, a relatively large amount of iron is required to produce the core, resulting in a bulky, slow-responding electromagnet. Conventional electromagnets encounter problems as a result of hard impact of the contacts during closure. Contact impact generates vibration and results in a high level of noise.

Several structures have been designed incorporating an L-shaped armature and variations in contact orientation. Such structures improve upon the conventional relay by reducing the overall size of the relay and increasing operating efficiency. One such structure is described in U.S. Pat. No. 4,323,869 to Minks. This reference describes a relay having an L-shaped armature pivotally mounted on its vertex to a stationary yoke. A flat spring lies flat against a portion of the armature when the relay is in the normal state. When the coil in the relay is energized, the armature pivots to close the contacts. The flat spring presses against one edge portion of the armature exerting a small torque upon it. When the coil in the relay is de-energized, the spring torque forces the armature back into its original state. After repeated operation of this relay, however, the spring can become permanently deformed by the force exerted by the armature, resulting in a decrease in the reliability of the relay.

Another relay having an L-shaped armature structure is described in U.S. Pat. No. 5,070,315 to Kuzukawa et al. Like the Minks relay, the armature is pivotally supported at its inner vertex onto a yoke. A pair of contacts is spaced above one leg of the armature wherein the lower contact rests against the armature leg. When the coil is energized, the armature pivots so that the leg of the armature biases the lower contact upwardly to press against the upper contact. Careful positioning and spacing of the contacts relative to the armature is needed in this relay to ensure proper operation. Since both contacts are remote from the operating armature, complex additional structure is needed to secure the contacts in the relay, increasing material cost.

Another example of a relay having remotely located contacts which are indirectly actuated by a rockable L-shaped armature is shown in U.S. Pat. No. 4,020,434 issued to Jaegle et al. The shape and orientation of the armature in the relay forms two working air gaps. When flux is generated, the air gaps co-operate with permanent magnets to pivot and hold the armature in the desired position. One disadvantage of this approach is that permanent magnets increase the weight and cost of the relay.

A relay structure utilizing two L-shaped components is disclosed in applicant's Russian Inventor's Certificate SU1494019. A coil is mounted on a curved portion of an L-shaped core to generate an attractive force on a pivotable L-shaped armature. This structure enables flux lines to travel through both legs of the armature and create an attractive force between the core and the armature on each leg. However, the orientation and location of the coil on the core causes a decrease in the attractive forces when the vertex of the armature approaches juncture between the core and the coil, causing a decrease in the torque acting on the armature.

DISCLOSURE OF THE INVENTION

It is an object of the present invention to provide an electromagnetic relay and contactor assembly which requires less magnetomotive force (MMF) in its operation than conventional relays and contactor assemblies without any loss in speed or reliability. As used herein, the terms "relay" and "contactor" are to be understood to be interchangeable.

It is also an object of the present invention to reduce the amount of noise and vibration of the contacts during operation of an electromagnet.

Another object of the present invention is to provide a compact relay and contactor assembly which offers substantial material savings in copper windings for coils.

Yet another object is to provide an electromagnet for a relay and contactor assembly which is simple to manufacture.

Accordingly, an electromagnet is provided having a generally L-shaped armature pivotally connected to an L-shaped core. The double L-shaped structure of the electromagnet forms two operative air gaps between the core and the armature, the first being located between the unconnected portions of the base and the armature and the second located between the connected portions of the core and the armature. A coil is disposed on one leg of the L-shaped core adjacent to its vertex. In a preferred embodiment, a spring is placed between the core and the armature near the pivot to bias the armature toward its non-energized position.

Several pairs of contacts are disposed on the side of the pivot opposite to the coil. The contacts may either be connected to the armature or actuated by a simple actuator connected to the armature.

When the coil is energized, the generated MMF engenders a magnetic flux through the core, the armature, and the air gaps. The resulting flux provides an attractive force which creates a torque and pivots the armature until the angle between the two L-shaped structures is zero and any effective air gap is minimized.

The first air gap increases the total magnetic conductivity of the electromagnet since the distance between the armature and the core at the first air gap is smaller than the distance at the second air gap. This increased magnetic conductivity enables the creation of a greater amount of magnetic flux per unit of MMF, thus decreasing the total amount of MMF required to operate the electromagnet. An attractive force is also generated across the first air gap to assist in holding the relay in its energized position. When the coil is de-energized, the spring forces the armature back to its normal position, opening normally open contacts or closing normally closed contacts.

The above objects and other objects, features, and advantages of the present invention are readily apparent from the following detailed description of the best mode for carrying out the invention when taken in connection with the accompanying drawings.

BRIEF DESCRIPTION OF THE DRAWINGS

FIG. 3 is a cross-sectional view of a second embodiment of the electromagnet for a relay or contact assembly;

FIG. 4 is a top plan view of a third embodiment of the electromagnet for a relay or contactor assembly; and FIG. 5 is a side elevational view of the third embodiment of the electromagnet for a relay or contactor assembly taken along line 5—5 of FIG. 4.

BEST MODE FOR CARRYING OUT THE INVENTION

Figure 1:
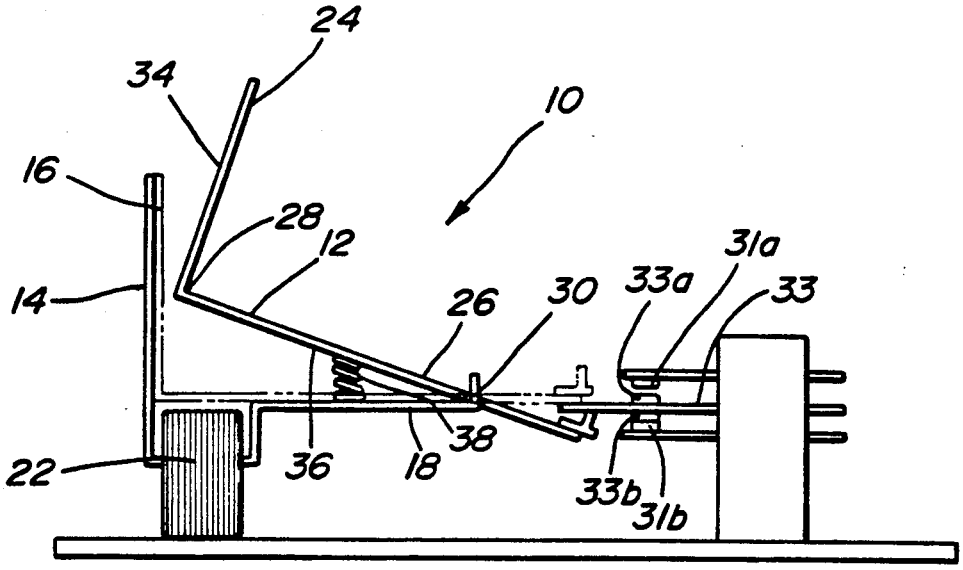
FIG. 1 is a side elevational view of an electromagnet for a relay or contactor assembly according to the present invention.
Figure 2:
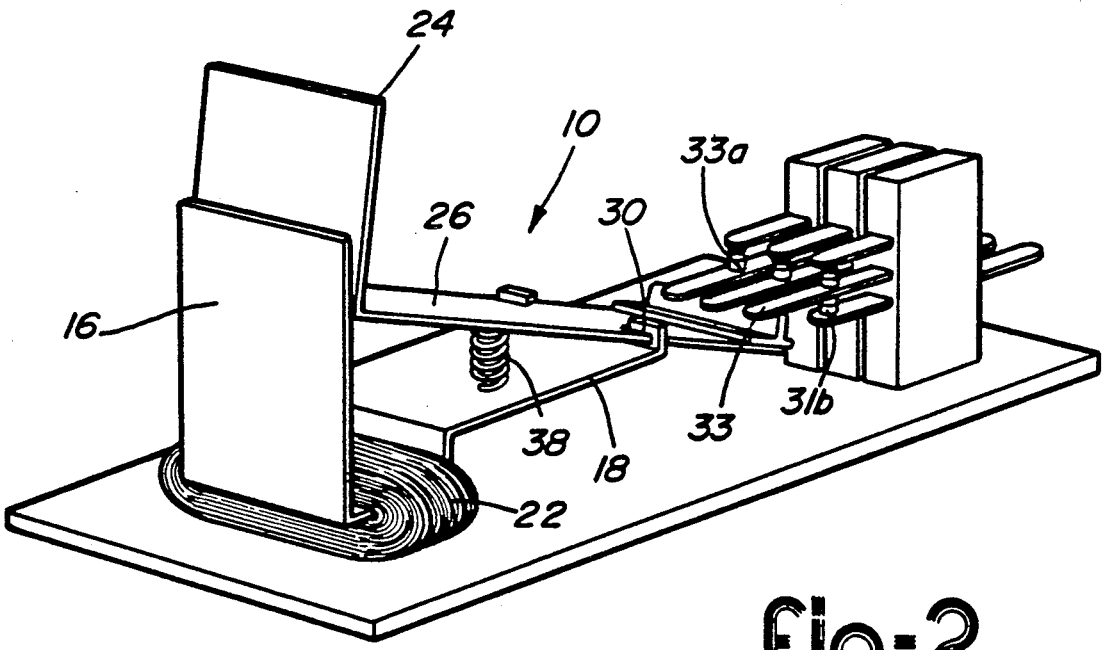
FIG. 2 is a perspective view of the relay or contactor.

Referring to FIGS. 1 and 2, an electromagnetic relay 10 is illustrated having an armature 12 pivotally mounted to a core 14. The core 14 has a first arm 16 and a second arm 18 extending generally perpendicularly relative to one another. A coil 22 is provided near the vertex of the core 14. The coil 22 is manufactured from an electrically conductive material and is preferably made of copper wire. The shape of the core 14 enables the required amount of copper to be wound around it while preventing the coil 22 from extending above the plane of the second arm 18.

The armature 12 has a first leg 24 and a second leg 26 extending at generally right angles from a common vertex 28. The core 14 and the armature 12 are preferably made from sheets of magnetically conductive material, such as iron or steel, formed into the desired L-shapes to allow the magnetic field created by a current passing through the coil 22 to flow through the relay 10.

The second leg 26 of the armature 12 is pivotally connected to the second arm 18 of the core 14 at a pivot axis 30. The distance between the pivot point 30 and the end of the second leg 26 is related to the amount of space desired between a set of contacts 31*a*, 31*b*. The distance between the pivot axis 30 and second leg 26 is preferably about one-third of the total length of the second leg 26. The distance will be determined by reference to the required spacing of contacts and the desired degree of arcuate movement of the leg. First and second sets of contacts 31*a*, 31*b* are attached on the side of pivot point 30 opposite the coil 22.

This arrangement enables the armature 12 to rotate at a wider angle than the armature of conventional electromagnetic relays. More specifically, the armature 12 can rotate around 35 to 40 degrees and can be adjusted to rotate up to 70 degrees, enabling an increase in the distance between contacts 31*a*, 31*b*.

In a preferred embodiment shown in FIGS. 1 and 2, a contact carrier 33 is placed between contacts 31*a*, 31*b*. Contacts 33*a* and 33*b* are disposed on opposite sides of contact carrier 33. When the armature 12 pivots, contact carrier 33 moves between contacts 31*a* and 31*b*. Energization of coil 22 pivots the armature 12 to push the contact carrier 33, closing contacts 31*a* and 33*a* and simultaneously opening contacts 31*b* and 33*b*.

The first leg 24 of the armature 12 and the first arm 16 of the core 14 together form a first working air gap 34. Similarly, the second leg 26 and the second arm 18 form a second working air gap 36. A spring 38 is placed in the second air gap 36 and connected to the armature 12 and the base 14. The spring 38 is preferably made of ferromagnetic material to provide a direct flux path between the components. The spring 38 biases the armature 12 toward its normal position when the coil 22 is de-energized.

During operation of the relay 10, current is conducted through the coil 22 to energize it and create a magnetic field. The magnetic field flows through the second arm 18 of the core 14, across the second air gap 36 to the second leg 26 of the armature 12, and across the first air gap 34 through the first arm 16 of the core 14. The spring 38 provides a magnetically permeable path for the magnetic field to concentrate and, therefore, partially increase the magnetic conductivity of the second air gap 36. The magnetic flux creates attractive forces which cause a torque to act on the armature 12, urging the armature 12 to pivot toward the core 14, thereby closing the normally open contacts 31*a*, 33*a* and opening the normally closed contacts 31*b* and 33*b* on the opposite side of the pivot point 30 and compressing the spring 38. The combined attractive forces generated across the first and second air gaps 34 and 36 enables smooth rotation of the armature 12 about the pivot axis 30.

When the coil 22 is de-energized, the attractive forces across the first and second air gaps 34 and 36 are removed. Consequently, the spring 38 decompresses and returns to its normal state, biasing the armature 12 back to its normal position.

In another embodiment of the invention shown in FIG. 3, the spring can be eliminated when the contactor 40 and contacts 42*a*, 42*b* are oriented so that the armature 44 is biased in its normal position by gravity. Contact 42*a* is placed on the second leg 46 of the armature 44. Contact 42*b* is disposed on an arm 48 mounted independently on a contactor support 49. In this configuration, no spring is needed to bias the armature 12 in its normal position and open the contacts 42*a*, 42*b*.

Referring now to FIGS. 4 and 5, an embodiment of the contactor 50 is shown where the distance between contacts and the contact pressure is independent of the pivot angle of the armature 52. An electrically insulative body, such as a truncated cylinder 54, is placed about the pivot axis and has a set of conductors 58 which are illustrated as being oriented in the same direction as the second leg 60 of the armature 52. The diameter of the truncated cylinder 54 can be chosen in view of the voltage and current of the contacts. The spring 62 is placed on the edge of the second leg 60 opposite the vertex of the armature 52. The contacts 64*a*, 64*b* are disposed on opposite sides of the truncated cylinder 54. With normally open contacts, there is no electrical connection between contacts 64*a*, 64*b*. When the coil 66 is energized, the armature 52 pivots relative to the core 68 and the conductors 58 are disposed horizontally to create an electrical connection between contacts 64*a* and 64*b*.

For normally closed contacts, the opposite conducting/non-conducting states would exist. The amount of pressure on the contacts 64*a*, 64*b* has no influence on the torque required by the armature 52. The MMF is used to rotate the armature 52.

The above description of preferred embodiments of the present invention is intended to be a detailed description of the best mode of carrying out the invention. It is to be understood that one of ordinary skill in the art will appreciate variations and modifications which should be construed to be within the scope of the following claims.

What is claimed is:

1. An electromagnet for a relay and contactor assembly comprising:

a core having a first arm and a second arm, said first arm an said second arm intersecting to form a common vertex of a predetermined angle;

a coil disposed on said second arm adjacent said common vertex, said coil receiving a current to create a magnetic field receivable by said first and second arms;

an armature having a first leg and a second leg, said first leg extending at an angle with respect to said second leg to receive said magnetic field such that said first leg is biased toward said first arm when the current is passing through said coil and a magnetic field is flowing through said first and second arms, said armature being movable between a first position when said coil is energized and a second position when said coil is de-energized; and a pivot defining a pivot axis connecting said second arm of said core and said armature, said pivot positioned between said coil and said contacts wherein said coil and said contacts are located on opposite sides of said pivot.

2. The electromagnet of claim 1 wherein the first arm of the core is generally perpendicular with respect to the second arm.

3. The electromagnet of claim 1 wherein the first leg of the armature if generally perpendicular with respect to the second leg.

4. The electromagnet of claim 1 wherein the contacts comprises a first contact, a second contact, and a contact carrier located in between the first and second contacts, the contact carrier having a third contact and a fourth contact wherein the first and third contacts are open and he second and fourth contacts are closed when the armature is one of said positions and the first and third contacts are closed and the second and fourth contacts are open when the armature is in the other of said positions.

5. The electromagnet of claim 1 further comprising a spring mounted between the second leg and the second arm to bias the armature in the second position.

6. The electromagnet of claim 5 wherein the spring is made of a ferromagnetic material whereby the spring provides a flux path between the core and the armature.

7. The electromagnet of claim 1 further comprising an extension arm connected to the armature for coupling the armature with the contactor assembly.

8. An electromagnet for a relay and contactor assembly comprising:

a core having a first arm and a second arm, the first arm extending from a common vertex perpendicularly with respect to the second arm;

a coil disposed about the second arm near the vertex;

an armature having a first leg and a second leg, the first leg extending perpendicularly with respect to the second leg, the armature being movable between a first position when the coil is energized and a second position when the coil is de-energized;

a pair of contacts coupled with the armature wherein the contacts are open when the armature is in one of said positions and the contacts are closed when the armature is in the other of said positions;

a pivot axis connecting the second arm of the core and the armature, the pivot axis positioned between the coil and the contacts wherein the coil and the contacts are located on opposite sides of the pivot axis;

an electrically insulative body disposed around the pivot axis, the body being rotatable between a first position and a second position corresponding with the first and second positions of the armature; and a spring connected to the second leg on the side of the pivot axis opposite the coil for biasing the armature in the second position.

9. The electromagnet of claim 8 further comprising a plurality of conductor disposed within the electrically insulative body, the conductors rotated by the second leg of the armature and the contacts being stationary relative to the core, the contacts and the conductors creating an electrical connection when the armature is in one of said positions.

10. The electromagnet of claim 8 wherein the body is elongated with an smooth portion at each end to facilitate rotation of the body.

11. The electromagnet of claim 9 wherein the body is elongated with an arcutate portion at each end to effect smooth rotation of the body.

* * * * *